United States Patent [19]

Scharf

[11] Patent Number: 4,920,577

[45] Date of Patent: May 1, 1990

[54] WORK PANTS

[76] Inventor: Gary W. Scharf, 10656 Marbury, San Diego, Calif. 92126

[21] Appl. No.: 251,300

[22] Filed: Sep. 30, 1988

[51] Int. Cl.[5] ..... A41D 1/06; A41D 17/00

[52] U.S. Cl. ..... 2/24; 2/268; 2/22

[58] Field of Search ..... 2/23, 24, 268, 267, 2/24, 22

[56] References Cited

U.S. PATENT DOCUMENTS

| | | | |
|---|---|---|---|
| 671,059 | 7/1901 | Sanders | 2/23 |
| 727,243 | 5/1903 | White | 2/23 |
| 932,990 | 8/1909 | Madill et al. . | |
| 2,355,193 | 8/1944 | Walker | 2/79 |
| 2,568,083 | 9/1951 | Mitchell | 2/231 |
| 4,561,123 | 2/1984 | Hull | 2/23 |
| 4,561,124 | 1/1982 | Thompson | 2/23 |
| 4,613,991 | 12/1985 | Grover | 2/23 |

OTHER PUBLICATIONS

Maurice Gershman, "Self adhering Nylon Tapes", The J.A.M.A., vol. 168, No. 7, Oct. 1958.

*Primary Examiner*—Werner H. Schroeder
*Assistant Examiner*—Jeanette E. Chapman
*Attorney, Agent, or Firm*—Brown, Martin, Haller & McClain

[57] ABSTRACT

A pair of work pants comprises two legs joined together at a crotch area, and a protective layer secured to the front of each leg having an upper edge no lower than the crotch area and a lower edge below the knee area, each protective layer being secured to the underlying material of the leg along its upper edge and opposite side edges to define a pocket in which a padding member is releasably received through the open lower end of the pocket. The lower edge of the protective layer is releasably securable to the front of the leg to secure the padding member in position.

5 Claims, 2 Drawing Sheets

FIG. 1
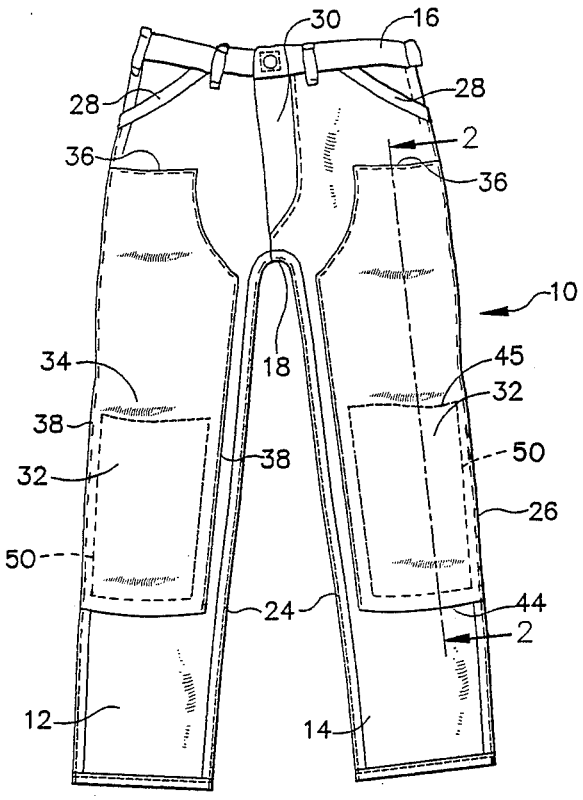
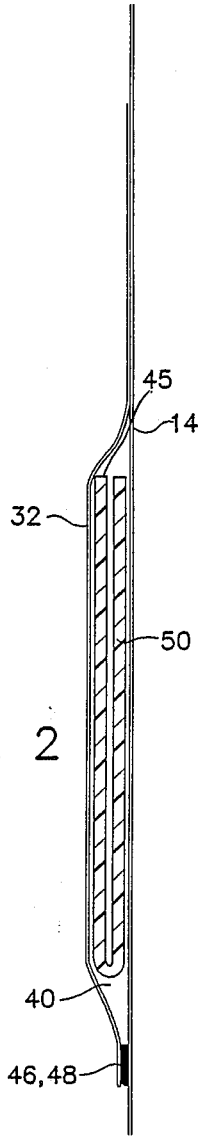
FIG. 2

WORK PANTS

BACKGROUND OF THE INVENTION

The present invention relates generally to work pants, and particularly to work pants designed for use in carpet laying or other activities requiring a lot of work in a kneeling position.

The job of carpet laying requires a substantial amount of kneeling, in which the knee and shin are in contact with the floor. Additionally, the carpet layer utilizes a tool generally known as a "kick stretcher" in order to stretch carpet at the edges, and this tool must be kicked, pressed or hit with the upper part of the knee or lower thigh repeatedly during carpet installation.

Various knee pads for protection of the knee areas in work pants have been proposed in the past. U.S. Pat. No. 4,613,991 of Grover describes work pants having removable leather patches secured to the underlying fabric on the front of the pants by zippers, with padding material removably held between the padding and underlying pants leg. The patches extend from a level approximately midway between the crotch area and knee area to a level below the knee area. One problem with this is that the upper portion of the zipper may be in line with the area of the leg used to hit the "kick stretcher" in carpet laying, causing considerable discomfort on repeated impacts, and possible injury. Also, any padding in the area of the thigh used for impact with the padding will cushion the impact with the kick stretcher, making it less effective.

Various other work pant designs with removable padding inserts are known. However, these are generally designed to cover the immediate knee area with the top of the inserts in the area of the lower thigh area which is also utilized repeatedly in carpet laying, causing discomfort. Other problems in these designs is that the material will tend to stretch and bunch up or wrinkle after repeated kneeling, standing and possibly impacts with a stretching tool in the case of carpet laying. Any wrinkles in the material will add to the potential pain or discomfort of the wearer.

SUMMARY OF THE INVENTION

It is an object of the present invention to provide improved work pants which are particularly useful for wear in carpet laying activity.

According to the present invention, work pants are provided which comprise two legs joined together at a crotch area, each leg having a front panel and a rear panel, and an additional protective layer secured over part of the front panel of each leg, the protective layer extending from an upper level of the respective leg no lower than the crotch area down to a level below the knee region, and having an upper edge and outer side edges secured to the front panel of the respective leg to form a pocket having an open lower end. A releasable securing device is provided at the lower end of the pocket for releasably securing the lower edge of the protective layer to the underlying region of the respective leg front panel. A generally flat padding member is provided for removably mounting in the pocket to extend from the lower end of the pocket to a level no higher than the top of the knee in a kneeling position.

Preferably, the securing device is adjustable to allow the protective layer to be tightened to accommodate any stretching or bunching up of the material after repeated kneeling or kicking activity. In the preferred embodiment, the securing device comprises opposed patches of hook and loop or Velcro (Registered Trade Mark) type fastener material applied to opposing regions at the lower edge of the protective layer and the underlying region of the pants leg.

With this arrangement, the area of the work pants used in kneeling, is padded, while the lower thigh region used in kicking or hitting a carpet stretching tool is left free of padding, and comprises a generally flat, double material layer region with no stitching, fasteners, or bunched up material in the area used to hit the carpet stretcher.

BRIEF DESCRIPTION OF THE DRAWINGS

The present invention will be better understood from the following detailed description of a preferred embodiment, taken in conjunction with the accompanying drawings, in which like reference numerals refer to like parts, and in which:

FIG. 1 is a front elevational view of a pair of work pants incorporating a protective layer according to a preferred embodiment of the invention;

FIG. 2 is a cross-section on the lines 2—2 of FIG. 1;

DESCRIPTION OF THE PREFERRED EMBODIMENT

Figure 3:
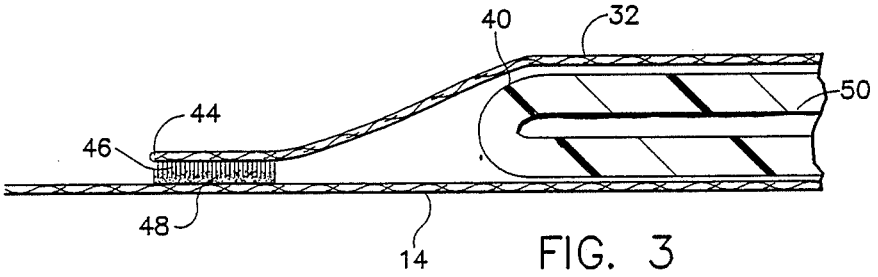
FIG. 3 is an enlarged sectional view of the lower part of the pocket in FIG. 2.

The drawings illustrate a pair of work pants 10 according to a preferred embodiment of the present invention. The pants are made of any suitable heavy wear fabric material, such as heavy cotton, denim or sail cloth material. The pants basically comprise a pair of legs 12, 14 extending downwardly from a waist area 16 and crotch area 18 to the ankle region of the wearer. Each leg consists of a front panel 20 and a rear panel (not shown) joined together along the inseam 24 and outseam 26 in a conventional manner. The waist area has front pockets 28 and a suitable fastener such as a zipper 30 in its front panel.

Figure 4:
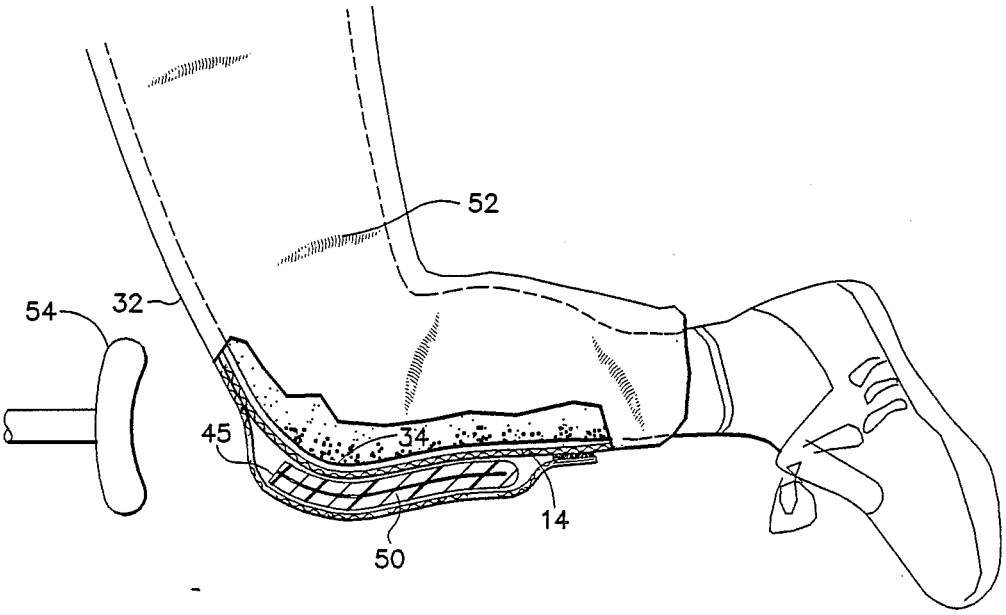
FIG. 4 is a side elevational view, partially sectioned, showing the pants in use.

A protective layer 32 is secured to the front panel of each leg and extends from a level immediately below the pockets 28 and above crotch area 18 down to a level below the knee region 34. The protective layer has an upper edge 36 and outer side edges 38 permanently secured to the underlying front panel of the respective leg by stitching or the like to define a pocket 40 between the opposing faces of the protective layer and front panel. The layer 26 preferably extends across the front panel of the leg with its opposite side edges located adjacent the inseam and outseam, respectively. Pocket 40 is open at its lower end below the knee region, with the lower edge 44 of the layer 26 releasably securable to the underlying regions of the leg front panel via a suitable fastening device such as opposing mating patches 46, 48 of interengageable hook and loop material or Velcro (Registered Trade Mark). A padding or cushion member 50 is removably received in pocket 40 as indicated in FIG. 2, and is of a length sufficient to extend from the lower edge 44 of the pocket up to a level 45 no lower than the top of the knee region 34 when the wearer is in a kneeling position, leaving the thigh region free, as illustrated in FIG. 4. The member 50 is a flattened layer of a suitable cushioning material such as foam, preferably cut to the size and shape of the pocket.

The foam layer may be covered with a fabric sleeve (not shown). The protective layer is suitably of the same material as the pants, although other materials may be used.

When the work pants illustrated in the drawings are worn during any work activity requiring kneeling, as illustrated in FIG. 4, the padding member 50 cushions and protects the knees of the wearer, so that the wearer can kneel for extended periods of time without suffering undue discomfort. FIG. 4 illustrates one leg 52 of a person wearing the pants in a kneeling position. If the pants are used by a person laying carpets, the region of the pants covering the lower thigh area of the wearer when kicking or hitting a carpet stretching tool 54 will be flat, unimpeded by any part of the padding, or any stitching or the like. The padding member lies flat between the opposing faces of the pocket to resist any tendency to bunch up on repeated bending and kicking activity. The padding member is preferably a doubled-over layer of padding with its fold at the lower edge of the pocket, as illustrated in the drawings. This arrangement reduces the risk of wrinkling or bunching up of the padding material.

Any bunching up of the material of the protective layer or padding member as a result of stretching on repeated kneeling and standing, which could result in pain or discomfort to the wearer, can be prevented by pulling the protective layer down until it is taut before attaching its lower edge to the front panel of the leg via the Velcro patches, which are designed to allow some vertical adjustment to the region of the front panel to which the lower edge of the protective layer is attached by varying the overlap between the opposing patches 46 and 48. This ensures that both the protective layer and underlying padding member are held as flat as possible, with little or no wrinkling or bunching up which could otherwise cause significant discomfort to the wearer. Should any wrinkling occur, the wearer can simply release the lower edge of the protective layer and pull it down until it is again taut before reattaching it to the underlying Velcro patch.

When the pants need washing, the padding member can be removed to be laundered separately. The padding member may be replaced with padding material of different hardness or softness, different thickness, and different sizes according to the particular application and the preference of the wearer. Thus, different lengths of padding 50 can be provided for wearer to select so that the upper edge is at or below the knee level on standing, to ensure no interference when hitting a kick stretching tool.

Although a preferred embodiment of the invention has been described above by way of example only, it will be understood by those skilled in the field that modifications may be made to the disclosed embodiment without departing from the scope of the invention, which is defined by the appended claims.

What is claimed is:

1. A pair of work pants, comprising:

two legs joined together at a crotch area, each leg comprising a front panel and a rear panel;

a protective layer secured to the front panel of each leg, each protective layer having an upper edge located no lower than the crotch area and a lower edge below the knee area, the upper edge and opposite side edges of the protective layer being secured to the front panel of the respective leg to define a pocket, the pocket having an opening at its lower end;

releasable securing means for releasably securing the lower edge of each protective layer to the front panel of the respective leg to close the pocket opening; and a padding member removably mounted in the pocket, the member having a lower edge adjacent to the lower end of the pocket and an upper edge no higher than the top of the knee when in a kneeling position;

the width of the padding member being no greater than the width of the pocket opening to allow insertion and removal of said padding member via said opening.

2. The pants as claimed in claim 1, wherein the securing means includes vertical adjustment means for varying the vertical position on the front panel to which the lower edge of the protective layer is attached.

3. The pants as claimed in claim 1, wherein the securing means comprises opposed interchangeable patches of hook and loop fastener material secured to respective opposing areas at the lower edge of the protective layer and the front panel of the respective leg below the knee region.

4. The pants as claimed in claim 1, wherein the upper edge and opposite side edges of the protective layer are secured to the front panel by stitching.

5. The pants as claimed in claim 1, wherein the padding member comprises a sheet of padding material folded over to form a double layer with opposing faces of the double layer in face to face engagement within the pocket and with the fold at the lower end of the pocket.

* * * * *